United States Patent [19]

Brubak et al.

[11] Patent Number: 5,067,994

[45] Date of Patent: Nov. 26, 1991

[54] ALUMINIUM ALLOY, A METHOD OF MAKING IT AND AN APPLICATION OF THE ALLOY

[75] Inventors: Jens P. Brubak; Bard Eftestøl; Ferenc Ladiszlaidesz, all of Raufoss, Norway

[73] Assignee: Raufoss AS, Oslo, Norway

[21] Appl. No.: 334,123

[22] Filed: Apr. 5, 1989

Related U.S. Application Data

[63] Continuation of Ser. No. 62,620, Jun. 16, 1987, abandoned.

[30] Foreign Application Priority Data

Jun. 20, 1986 [NO] Norway ..... 862466

[51] Int. Cl.[5] ..... C22C 21/00; B22D 25/00

[52] U.S. Cl. ..... 148/415; 148/3; 148/12.7 A; 148/416; 148/417; 148/437; 148/438; 148/439; 148/440; 420/528; 420/535

[58] Field of Search ..... 148/415, 416, 417, 437, 148/438, 439, 440, 12.7 A

[56] References Cited

U.S. PATENT DOCUMENTS 3,770,515 11/1973 Besel ..... 148/11.5 A
4,347,076 8/1982 Ray et al. ..... 148/438

FOREIGN PATENT DOCUMENTS 1291039 3/1962 France .
2311391 12/1976 France .

OTHER PUBLICATIONS

Chemical Abstracts, 104, No. 18, 5-5-86, p. 327, abstract No. 154155g.
Chemical Abstracts, 103, No. 10, 9-9-85, p. 235, Abstract No. 74927z.
Chem. Abstracts 104, No. 6, 2-10-86, p. 291, No. 38439d.
Chem. Abstracts 78, No. 19, 4-9-73, p. 239, No. 87918n.

*Primary Examiner*—R. Dean
*Assistant Examiner*—Robert R. Koehler
*Attorney, Agent, or Firm*—Bacon & Thomas

[57] ABSTRACT

Aluminium alloy and a method of making it, whereby the alloy contains Zr and from 0 to 1% of one or more of the elements Mg, Si, Ag, Ni and Cu, the balance being mainly Al, the alloy being made on the basis of a melt which contains 0.5 to 2% by weight of Zr and which has been cast into particles by being cooled with such a high velocity that the Zr mainly is present in a supersaturated solution. The particles are consolidated and the Zr is precipitated as finely distributed dispersoids after a heat treatment at 300° to 450° C., and the alloy has an electrical conductivity of at least 58% IACS and a 10% softening temperature of at least 400° C. The consolidation may for instance be carried out by extrusion.

16 Claims, 2 Drawing Sheets

ALUMINIUM ALLOY, A METHOD OF MAKING IT AND AN APPLICATION OF THE ALLOY

This application is a continuation, of application Ser. No. 062,620 filed June 16, 1987, now abandoned.

The present invention relates to a heat resistant aluminium alloy for electrically conductive wires, having the combination of improved conductivity, temperature resistance and mechanical properties.

The conventional alloys for conductive wires, such as E-AlMgSi, AlMgCu and AlMg partly have a favourable combination of strength and conductivity, but the heat resistance is poor. The highest temperature for which these alloys can be used is in the range of 100°-150° C. Even short periods of temperature above this range will lead to a substantial strength reduction.

It is known to make alloys based on elements from the transition metals, such as Fe and Zr, in order to achieve alloys having improved heat resistance. Even though the heat resistance of such alloys has been increased the combination of conductivity and mechanical strength is low compared with the above mentioned conventional alloys.

When usual processes of manufacture are used, including casting of blocks for continued treatment or continuous casting and subsequent rolling the amount of Zr which can be advantageously used is limited to 0.3 to 0.5%. An increase of the amount of Zr will lead to that some of the $Al_3Zr$ particles which are precipitated during the cooling and solidification will be so large that they have no advantageous effect with respect to strength or heat resistance. Moreover, the creation of large particles leads to a reduced amount of small particles which have an advantageous effect. Thus, for a given solidification velocity there is an upper limit of the amount of Zr which can be added with an advantageous result.

The above circumstances are explained in U.S. Pat. No. 4,402,763, which describes a heat resistant aluminium alloy containing 0.23 to 0.35% Zr, whereby the upper limit of the Zr content should not be exceeded because this will lead to adverse effects. The patent describes the use of the alloy by continuous casting or by casting into blocks, whereupon a further treatment is carried out in the form of hot-working or cold-working.

It is well known that an increase of the solidification velocity of an alloy comprising aluminium and transition elements makes it possible to increase the amount of transition elements without resulting in large intermetallic phases. This also applies to Al-Zr, so that an increased solidification velocity makes it possible to achieve an increased amount of finely dispersed favourable $Al_3Zr$ particles in the structure. The finely dispersed $Al_3Zr$ particles are formed partly during the solidification and partly during the continued cooling after the solidification, but they may also be formed by heat treatment of a supersaturated matrix. The ratio between particles which are precipitated during the solidification, primary particles, and particles which are precipitated in a solid state, secondary particles, and the amount of Zr which after cooling to room temperature are dissolved in the matrix and which by a subsequent heat treatment can be precipitated as finely distributed dispersoids, depends primarily of the solidification and cooling velocity and the amount of Zr in the alloy.

The object of the present invention is to achieve an alloy which has a Zr content in the range of 0.5 to 2% and which does not contain large, adverse $Al_3Zr$ particles.

Another object is to achieve a method of making such an alloy.

The alloy and the method according to the invention are defined in the patent claims.

In summary, the invention relates to an aluminum alloy and a method of making it, whereby the alloy contains Zr and from 0 to 1% of one or more of the elements Mg, Si, Ag, Ni and Cu, the balance being mainly Al, the alloy being made on the basis of a melt which contains 0.5 to 2% by weight of Zr and which has been cast into particles by being cooled with such a high velocity that the Zr mainly is present in a supersaturated solution. The particles are consolidated and the Zr is precipitated as finely distributed dispersoids after a heat treatment at 300° to 450° C., and the alloy has an electrical conductivity of at least 58% IACS and a 10% softening temperature of at least 400° C. The consolidation may for instance be carried out by extrusion.

In order to increase both the solidification velocity and the cooling velocity relatively to conventional processes the method of the present invention comprises that the melt is poured down into a rapidly rotating crucible having a large number of holes in the side wall, in the dimensional range of 0.1 to 3 mm. Thereby are formed small droplets of melt which solidify into needle shaped particles while falling through the air outside of the crucible. Depending on the rotational velocity of the crucible, the diameter of the holes and the temperature of the melt the needle shaped particles will have a largest diameter in the range of 0.1 to 2 mm, and their length will be in the range of 2 to 20 mm. Based on measurements of the distances between the dendrite arms the cooling velocity has been found to be in the range of 100° to 1000° C. per second.

Making of such needles of an AlZr alloy has proven that a material can be achieved which contains for instance 1% Zr without any large, advers $Al_3Zr$ particles. Moreover it has been proven that the material due to the increased solidification and cooling velocity contains a large amount of Zr in a supersaturated solution.

The needles can be consolidated by extrusion, and they may be drawn into wire. After a heat treatment the wire has a combination of strength, ductility, conductivity and heat resistance which is better than for previously known alloys.

The invention will hereinafter be explained more detailedly, with reference to the accompanying drawings.

Figure 1:
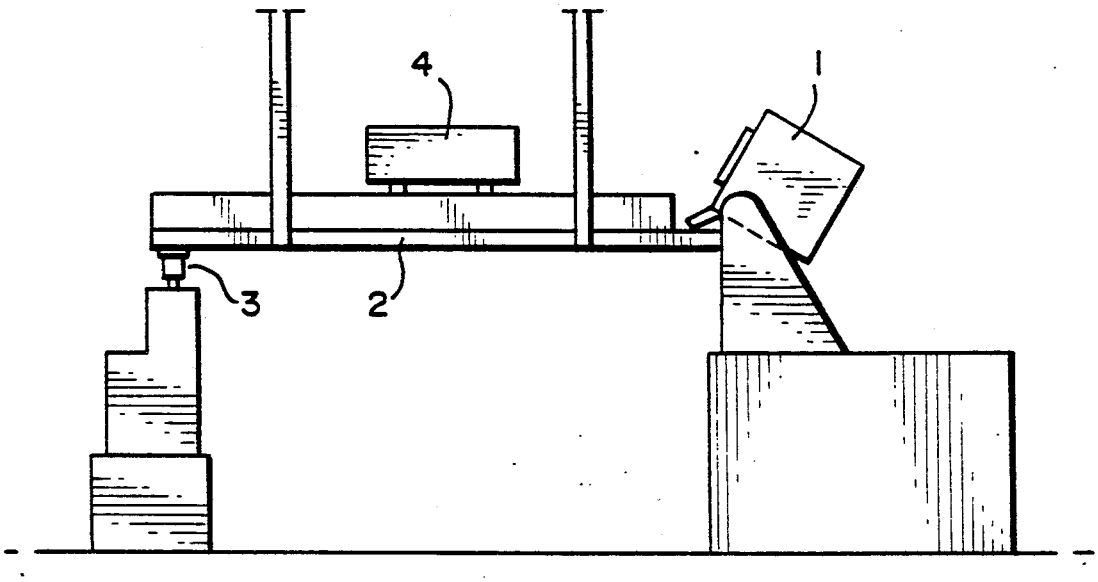
FIG. 1 shows diagrammatically an installation for casting of needles.

As shown in FIG. 1 the needles are cast by firstly melting the alloy elements in a furnace 1. The melt flows in a gutter or channel 2 which leads to a perforated crucible 3. The installation has a control panel 4. The melt will flow through the holes in the rotating crucible and fall through the space surrounding the crucible, to a floor. During the flight the melt solidificates into needles. The gutter or channel comprises heating elements, and the temperature of the melt can be adjusted.

Figure 2:
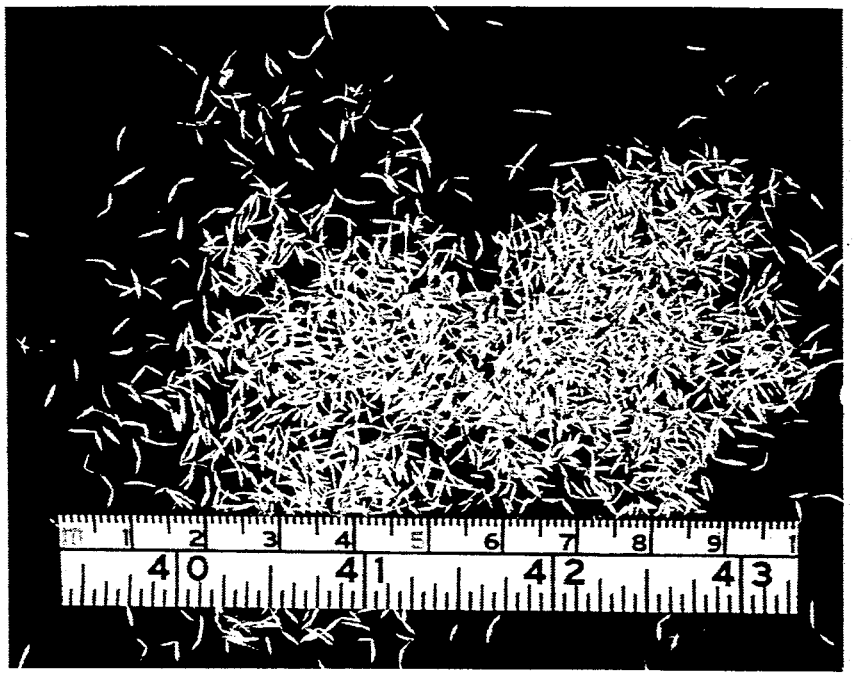
FIG. 2 shows the cast needles and their dimensions.

The needles are shown in FIG. 2, and it appears that in this example the needle length is approximately 3 to 8 mm.

Figure 3:
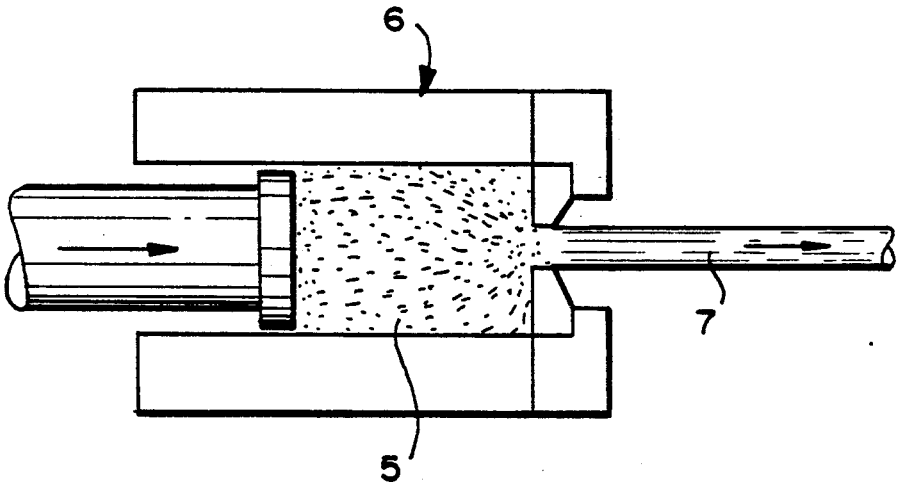
FIG. 3 shows extrusion of the cast needles.

FIG. 3 shown extrusion of the needles 5, which have been transferred to an extrusion press 6 and are extruded in the form of a rod 7 having the desired cross sectional shape.

An alloy and a method according to the invention and properties of the alloy are by way of example shown in a succeeding table.

An Al alloy containing 1% Zr was made by adding pure Zr to a melt of 99.7% Al. The melt temperature was adjusted to 850° C., and needles were cast by use of the rotating crucible 3, as shown in FIG. 1. The gutter 2 was adjusted to give a casting temperature of 850° C.

After cooling the needles were heated in air to 450° C. during 10 minutes and filled into the container of an extrusion press for aluminium profiles, and the needles were consolidated to a bolt of 12 mm diameter. The extruded bolt was cooled in water.

The extruded bolt was cold-drawn in the following steps, defined by the diameter in mm: 11-10-9-8.5-8-7.5-7-6.5-6-5.5-5-4.5-4-3.5-3-2.7-2.5-2.2-2--1.8-1.6 without any intermediate heating.

A wire of 3 mm diameter was tested with respect to its properties as a function of the treatment time in 400° C. The results are given in the following table.

| Alloy | Heat treatment | Tensile strength N/mm² | Ductility A250-% | Conductivity % IACS | 10% softening temp. °C. |
|---|---|---|---|---|---|
| AlZr1 - 3 mm θ | none | 240 | 10 | 42,5 | — |
| AlZr1 - 3 mm θ | 400° C./1 h | 286 | 23 | 53,1 | 400 |
| AlZr1 - 3 mm θ | 400° C./10 h | 265 | 24 | 59,5 | 400 |
| AlZr1 - 3 mm θ | 400° C./60 h | 240 | 24 | 60,7 | 425 |
| AlZr1 - 3 mm θ | 400° C./100 h | 222 | 26 | 61,3 | 425 |
| AlZr1 - 3 mm θ | 400° C./500 h | 185 | 28 | 63,0 | 425 |
| EC-AlSiO,5MgO,5[1] | — | 295 | 3,5 | 54,5 | 125[2] |
| EC-Al[3] | — | 240 | 14 | 61,5 | 125 |
| EC-AlSiO,5MgO,5[4] | — | 313 | 3,5 | 54,4 | 125[2] |
| AlFeO,75[5] | — | 121 | 13 | 59,5 | —[6] |
| AlCuO,2MgO,005[5] | — | 119 | 19 | 60,3 | —[6] |
| Alloy 1350[7] | — | 178 | — | 61,8 | 125 |
| Al—Zr[8] | — | 165/184 | — | 60,1/58,9 | 425 |

[1]Minimum values according to Norwegian Standard of alloy wires.
[2]10% softening temp. is not specified in the standard.
[3]Sample taken from EC-Al wire.
[4]Minimum values according to Swedish Standard 4240812 of alloy wires.
[5]For alloy wires in soft-glowed condition according to Aluminium Taschenbuch.
[6]10% softening temp. not specified. The strength will not decrease, due to the soft-glowed condition.
[7]Sample of a conventional alloy according to U.S. Pat. No. 4,402,763.
[8]Values achieved with Al—Zr alloy according to U.S. Pat. No. 4,402,763.

The usefulness of a material in electrical conductors depends on such factors as strength, conductivity, heat resistance and ductility. The relative importance of the factors will vary with different applications.

It appears from the table that the alloy according to the invention differs substantially from prior art alloys with respect to combinations of important material parameters.

Hereinbefore the invention has been described by means of an example where 1% Zr was used. This is, however, no limitation of the scope of the invention, which is based on the possibilities of taking advantage of a higher amount of alloy elements made possible by an increased solidification and cooling velocity.

A similar advantageous effect can be achieved within a wide range with respect to the content of Zr. Structural studies of needles made in accordance with the invention indicate that the range from 0.5 to 2% is of particular interest. The effect of the cooling velocity with respect to the size and the distribution of the $Al_3Zr$ particles, and hence the combined properties of the material, will also appear when such elements as Mg, Cu, Si, Ag and Ni are added, separately or in combination. This makes it possible to achieve a still more increased strength, and widens the range of possible combinations of properties.

It is also known that the heating velocity of an Al-Zr alloy in which Zr appears in supersaturated solid solution is of great importance with respect to the shape, size and distribution of the $Al_3Zr$ particles which are formed. In the above example the needles were rapidly heated to the extrusion temperature. Another heating velocity would lead to another distribution of particles and different properties with respect to extrusion av drawing of wire. Such a different distribution with respect to the particle distribution and shape will lead to a different response to the final heat treatment, which in the example was carried out at 400° C. Thus, the velocity with which the rapidly solidified needles are heated prior to the hot-working by extrusion is a parameter of importance to the final properties of the wire.

In the example was used a final heat treatment at 400° C. Similar properties can be achieved with other combinations of temperature and treatment time.

Since the combination of mechanical and electrical properties of the material herein disclosed after having been subjected to the heat treatment only to a small extent has shown to depend on the cold working during wire drawing the alloy may be used without further treatment in the form of extruded tubes and bars, for instance as electrical conductors, such as in transformer stations.

We claim:

1. An aluminum alloy consisting essentially of Al, 0 to 1% by weight of at least one element which is Mg, Si, Ag, Ni or Cu, and from 0.5 to 2.0% by weight of Zr; said alloy having been made from an aluminum melt consisting essentially of Al, 0.5 to 2.0% by weight of Zr and from 0 to 1% by weight of at least one element which is Mg, Si, Ag, Ni or Cu, said melt having been cast into needle shaped particles by being cooled at a rate of 100°-1,000° C./sec. so that Zr mainly is present in supersaturated solution, said particles having been consolidated and the Zr being present in the form of finely distributed dispersoids after a heat treatment at 300° to 450° C., said aloy having an electrical conductivity of at least 58% IACS and a 10% softening temperature of at least 400° C.

2. The aluminum alloy of claim 1, which was consolidated by extrusion.

3. The aluminum alloy of claim 1, wherein the sum of its tensile strength in $kp/mm^2$ and its electrical conductivity in % IACS is at least 80.

4. The aluminum alloy of claim 1 in the form of conductive wires.

5. The aluminum alloy of claim 2 in the form of conductive wires.

6. A method of making an aluminum alloy consisting essentially of aluminum, from 0.5 to 2.0% by weight of Zr and from 0 to 1% of at least one of the elements Mg, Si, Ag, Ni, or Cu, which comprises forming an aluminum melt consisting essentially of Al, 0.5 to 2.0% by weight of Zr and from 0 to 1% by weight of at least one element which is Mg, Si, Ag, Ni or Cu, casting said melt into needle-shaped particles at a cooling velocity of 100°-1,000° C./sec so that the Zr mainly occurs in supersaturated solution in the particles, consolidating said particles whereupon the Zr is precipitated as finely distributed Al-Zr dispersoids by heat treatment in the temperature range of 300° to 400° C., said alloy having an electrical conductivity of at least 58% IACS and a 10% softening temperature of at least 400° C.

7. The method of claim 6 wherein the particles are deformed plastically during the consolidation process.

8. An aluminum alloy consisting essentially of Al, 0 to 1% by weight of at least one element which is Mg, Si, Ag, Ni, or Cu, and from 0.5 to 2.0% by weight of Zr, and wherein a large amount of the Zr is present in a supersaturated solution said alloy having been solidified into needle-shaped particles from a melt at a cooling rate of 100°-1,000° C./sec.

9. A method of making an aluminum alloy which comprises:

a. forming an aluminum alloy melt, said alloy consisting essentially of aluminum; 0-1% by weight of at least one element selected from the group consisting of Mg, Si, Ag, Ni and Cu; and from about 0.5-2.0% by weight of Zr;

b. casting said melt into needle shaped particles at a cooling velocity of 100° C.-1,000° C./sec. to form a ductile alloy wherein Zr is mainly present in a supersaturated solution;

c. consolidating the needle shaped ductile particles into a unitary structure and heat treating the alloy in a temperature range of 300°-450° C.

10. The aluminum alloy formed by the process of claim 9.

11. The method of claim 9 wherein the alloy is heat treated after consolidation at a temperature of 400° C.

12. The aluminum alloy formed by the process of claim 11.

13. The method of claim 9 which further includes the steps of cold drawing the unitary structure into a wire and then heat treating the wire at 400° C.

14. An aluminum alloy in the form of a wire formed by the process of claim 13.

15. An aluminum alloy consisting essentially of Al, 0 to 1% by weight of at least one element which is Mg, Si, Ag, Ni, or Cu, and from 0.5 to 2.0% by weight of Zr, and wherein a large amount of Zr is present in a supersaturated solution; said alloy having been solidified into needle shaped particles from a melt at a cooling rate of 100°-1,000° C./sec wherein the needles have a largest diameter of 0.1 to 2.0 mm and a length in the range of 2 to 20 mm.

16. An aluminum alloy wire formed by extrusion of the aluminum alloy of claim 15 wherein the sum of its tensile strength in $Kp/mm^2$ and its electrical conductivity in % IACS is about 80.

* * * * *